US010119744B2

(12) United States Patent
Lee

(10) Patent No.: US 10,119,744 B2
(45) Date of Patent: Nov. 6, 2018

(54) ICE MAKER FOR REFRIGERATOR AND METHOD FOR DEODORIZING THE SAME

(71) Applicant: Dongbu Daewoo Electronics Corporation, Seoul (KR)

(72) Inventor: Wang Goo Lee, Seoul (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 243 days.

(21) Appl. No.: 14/839,469

(22) Filed: Aug. 28, 2015

(65) Prior Publication Data

US 2016/0370086 A1 Dec. 22, 2016

(30) Foreign Application Priority Data

Jun. 16, 2015 (KR) ..... 10-2015-0085299

(51) Int. Cl.

| | |
|---|---|
| ***F25D 23/00*** | (2006.01) |
| ***A61L 9/01*** | (2006.01) |
| ***F25D 17/04*** | (2006.01) |
| ***F25C 1/24*** | (2018.01) |
| ***F25D 17/06*** | (2006.01) |
| ***F25D 29/00*** | (2006.01) |
| ***F25C 5/20*** | (2018.01) |

(52) U.S. Cl.

CPC ..... *F25D 17/042* (2013.01); *F25C 1/24* (2013.01); *F25C 5/22* (2018.01); *F25C 5/24* (2018.01); *F25D 17/065* (2013.01); *F25D 29/003* (2013.01)

(58) Field of Classification Search

CPC .. F25C 1/24; F25C 5/005; F25C 5/007; F25D 29/003; F25D 17/065; F25D 17/042; F25D 23/00; A61L 9/01

See application file for complete search history.

(56) References Cited

U.S. PATENT DOCUMENTS 5,568,730 A * 10/1996 Kim ..... F25D 17/042 422/123
7,874,460 B2 1/2011 Jang et al.
(Continued)

FOREIGN PATENT DOCUMENTS

JP 2003148861 A * 5/2003
JP 4094276 B2 6/2008
(Continued)

OTHER PUBLICATIONS

Extended European Search Report dated Oct. 17, 2016 issued in corresponding European Patent Application No. 15186848.6.

*Primary Examiner* — Frantz Jules
*Assistant Examiner* — Martha Tadesse

(57) ABSTRACT

An ice maker for refrigerator. The ice maker includes a case for protecting a cooling space to which cold air is supplied, an ice making assembly for making ice by using the cold air in the cooling space, an ice bucket for containing the ice made by the ice making assembly in the cooling space, a discharge assembly having an insulation space which is provided as a path through which the ice contained in the ice bucket is discharged to the outside of the case, and a deodorizing filter placed on a cold air channel that allows the cold air to go by the ice bucket after the cold air coming from the ice making assembly passes through the insulation space.

12 Claims, 4 Drawing Sheets

(56) References Cited

U.S. PATENT DOCUMENTS

| | | | | |
|---|---|---|---|---|
| 8,157,882 | B2 * | 4/2012 | Curtis | B01D 45/08 261/DIG. 88 |
| 8,517,483 | B2 * | 8/2013 | Eubanks | F25D 17/042 312/404 |
| 2003/0046947 | A1 * | 3/2003 | Ohya | A61L 9/16 62/264 |
| 2004/0237544 | A1 * | 12/2004 | Ueno | A61L 9/16 62/78 |
| 2007/0065332 | A1 * | 3/2007 | Stiros | A61L 9/014 422/5 |
| 2007/0224157 | A1 * | 9/2007 | Kim | A61L 9/014 424/76.2 |
| 2010/0307184 | A1 | 12/2010 | Jung | |
| 2011/0100046 | A1 * | 5/2011 | Choi | F25D 17/065 62/320 |
| 2012/0017630 | A1 * | 1/2012 | Okabe | B05B 5/16 62/407 |
| 2012/0174613 | A1 * | 7/2012 | Park | F25C 5/046 62/320 |
| 2012/0204581 | A1 * | 8/2012 | Kang | F25D 17/042 62/78 |
| 2014/0000303 | A1 * | 1/2014 | Jeong | F25C 5/007 62/344 |

FOREIGN PATENT DOCUMENTS

| | | | |
|---|---|---|---|
| JP | 2003-148861 | A | 5/2013 |
| KR | 10-2001-0076101 | A | 8/2001 |
| KR | 10-2009-0043992 | | 5/2009 |
| KR | 10-2012-0080722 | A | 7/2012 |

* cited by examiner

ICE MAKER FOR REFRIGERATOR AND METHOD FOR DEODORIZING THE SAME

CROSS-REFERENCE TO RELATED APPLICATIONS

The present application claims priority to and the benefit of the Republic of Korea Patent Application Serial Number 10-2015-0085299, entitled ICE MAKER FOR REFRIGERATOR AND METHOD FOR DEODORIZING THE SAME, having a filing date of Jun. 16, 2015, the disclosure of which is herein incorporated by reference in its entirety.

FIELD OF THE INVENTION

The present invention relates to an ice maker for refrigerators and a method for deodorizing the same, and, more particularly, to an ice maker having a deodorization ability and a method for deodorizing the ice maker.

BACKGROUND

A refrigerator unit is a device intended to store food items at low temperatures. The refrigerator unit may be composed of a refrigerating compartment and a freezer compartment, both of which are configured for storing food and drink for longer periods of time than without refrigeration.

The inside of a refrigerator unit is cooled by supplying cold air of a desired temperature that is continually generated through a heat exchanging operation of a refrigerant based on a refrigeration cycle. The cycle includes a process of compression-condensation-expansion-evaporation. The cold air supplied to the inside of the refrigerator unit is evenly transferred by a convection current to store food and drink items within the refrigerator at a desired temperature.

In general, a refrigerator body of the refrigerator unit has a cuboidal or rectangular shape with an open front side providing access to a refrigeration chamber and a freezer chamber located within the body of the refrigerator unit. Further, hinged doors may be fitted to the front side of the refrigerator body in order to selectively open and/or close openings to the refrigeration chamber and the freezer chamber. In addition, a number of drawers, racks, shelves, storage boxes, and the like may be provided in the refrigeration chamber and the freezer chamber within the refrigerator unit configured for storing various food and items within the interior of the refrigerator unit.

Conventionally, refrigerators were configured as a top mount type in which a freezer chamber is positioned above a refrigeration chamber. Recently, bottom freeze type refrigerators position the freezer chamber below the refrigeration chamber to enhance user convenience. In the bottom freeze type refrigerator, the more frequently used refrigeration chamber is advantageously positioned at the top so that a user may conveniently access the chamber without bending over at the waist, as previously required by the top mount type refrigerator. The lesser used freezer chamber is positioned at the bottom.

However, a bottom freeze type refrigerator may lose its design benefits when a user wants to access the lower freezer chamber on a more frequent basis. For example, prepared ice that is stored in the freezer chamber may be a popular item accessed frequently by a particular user. In a bottom freeze type refrigerator, since the freezer chamber is positioned below the refrigeration chamber, the user would have to bend over at the waist in order to open the freezer chamber door to access the ice. To a frequent ice user, uncomfortably accessing the freezer chamber numerous times may outweigh the benefits of providing ease of access to the refrigeration chamber.

In order to solve such a problem, bottom freeze type refrigerators may include a dispenser configured for dispensing ice that is provided in a refrigeration chamber door. In this case, the ice dispenser is also positioned in the upper portion of the refrigerator unit, and more specifically is located above the freezer chamber. In this case, an ice maker for generating ice may be provided in the refrigeration chamber door or in the interior of the refrigeration chamber.

The ice maker may include an ice making assembly having an ice tray for making ice (e.g., ice cubes), an ice bucket for storing the ice, and a transfer assembly for transferring the ice stored in the bucket to the dispenser. The ice made in the ice making assembly is dropped to the ice bucket positioned at the bottom of the ice tray, and then may be piled up in the inside of the ice bucket.

Meanwhile, the refrigerator unit is an apparatus for keeping food refrigerated at temperatures necessary for storing food. It is very common for the interior of the refrigerator unit to absorb odors from the food being stored. In turn, food and drink items stored in the refrigerator unit may also absorb odors from each other and from odor lingering in the interior. As examples, fermented foods (e.g., kimchi, cheese, and so on) may give off a unique odor typical of fermented foods, and fish may give off a unique fishy smell.

For this reason, a deodorizing device, for filtering smelly odors in the air, may be included within refrigerator units. The deodorizing device circulates air contained within a refrigerator compartment (e.g., refrigeration chamber, freezer chamber, etc.) and then filters the circulated air.

However, according to the prior art, the deodorizing function of the deodorizing device does not reach an inner space of the ice maker, or is ineffective. This is because the ice maker is protected by a case, which separates the interior of the deodorizing device from the interior of the refrigerator unit. That is, filtered air circulating between the deodorizing device and the interior of the refrigerator unit does not filter air within the ice maker.

Further, because the air within the ice maker is unfiltered, once a smelly odor caused by food and drink items has penetrated into the interior of the ice maker, it is difficult to discharge that odor to the exterior of the ice maker. As a result, the ice made and stored within the ice maker may absorb the smelly odor.

What is needed is a way to deodorize air in an ice maker of a refrigerator unit.

SUMMARY

In view of the above, therefore, embodiments of the present invention provide an ice maker for deodorizing cold air that is supplied to a cooling space within the ice maker to make ice, and a method for deodorizing the cold air.

In accordance with one embodiment of the present invention, there is provided an ice maker for a refrigerator unit. The ice maker may include a case for protecting a cooling space to which cold air is supplied, an ice making assembly in the cooling space for making ice using the cold air, an ice bucket for storing the ice made by the ice making assembly in the cooling space, a discharge assembly having an insulation space which is provided as a path through which the ice stored in the ice bucket is discharged to the outside of the case, and a deodorizing filter placed on and/or within a cold air channel that allows the cold air to pass over and/or go by the ice bucket after the cold air moves through the ice making assembly and passes through the insulation space. The deodorizing filter is disposed in the insulation space. The ice maker may further include a partition installed between the ice making assembly and the discharge assembly. The partition is configured to divide the cooling space and the insulation space. The partition comprises a ventilator configured for providing the cold air channel formed at least between the cooling space and the insulation space. The discharge assembly comprises an insulation case having an insulation wall which forms the insulation space. The insulation case is configured to discharge the cold air moving through the insulation space and passing to the outside of the ice maker through a discharge port formed at one side of the insulation wall. The discharge assembly comprises a heater for increasing a temperature of the cold air before it is discharged to the outside of the ice maker the discharge port. The deodorizing filter is accommodated in a filter case that is attached to the insulation case and located in the insulation space of the discharge assembly.

In accordance with another embodiment of the present invention, a method for deodorizing an odor of an ice maker used in a refrigerator unit is disclosed. The method may include making ice by an ice making assembly using cold air in a cooling space that is protected by a case, storing the ice made by the ice making assembly in the cooling space, deodorizing the cold air going through and passed from the ice making assembly along at least a portion of a cold air channel by using a deodorizing filter placed on and/or within the cold air channel, and allowing the cold air deodorized by the deodorizing filter to pass over and/or go by the ice bucket along at least another portion of the cold air channel. In the method, the deodorizing filter is disposed in the insulation space. The method may further include discharging the cold air to the outside of the ice maker through a discharge port formed at one side of an insulation wall of the discharge assembly, wherein the discharge assembly forms the insulation space. The method may further include increasing a temperature of the cold air before discharging it to the outside of the ice maker through the discharge port.

In accordance with another embodiment of the present invention, a refrigerator including an ice maker with deodorizing capabilities is disclosed. The refrigerator includes a freezer compartment located within a main body of the refrigerator. The refrigerator includes a refrigeration compartment located within the main body of the refrigerator. The refrigerator includes a case located within the refrigeration compartment, wherein the case is configured for protecting a cooling space to which cold air is supplied. The refrigerator includes an ice making assembly for making ice by using the cold air in the cooling space. The refrigerator includes a discharge assembly comprising an insulation space, wherein the discharge assembly is configured to provide a path through which the ice stored in the ice bucket is discharged to the outside of the case. The refrigerator also includes a deodorizing filter placed in a path of a cold air channel that is configured to allow the cold air to circulate from the insulation space to the ice bucket after the cold air circulates from the ice making assembly to the insulation space.

According to some embodiments of the present invention, cold air supplied to the cooling space of the ice maker and used to make ice is deodorized by the ice maker. Accordingly, although an odor caused by food and/or drink items stored in the refrigerator unit penetrates to the inside of the ice maker, the odor is immediately deodorized, and thus is not absorbed into the ice stored in the ice bucket.

BRIEF DESCRIPTION OF THE DRAWINGS

The accompanying drawings, which are incorporated in and form a part of this specification and in which like numerals depict like elements, illustrate embodiments of the present disclosure and, together with the description, serve to explain the principles of the disclosure.

DETAILED DESCRIPTION

Reference will now be made in detail to the various embodiments of the present disclosure, examples of which are illustrated in the accompanying drawings. While described in conjunction with these embodiments, it will be understood that they are not intended to limit the disclosure to these embodiments. On the contrary, the disclosure is intended to cover alternatives, modifications and equivalents, which may be included within the spirit and scope of the disclosure as defined by the appended claims. Furthermore, in the following detailed description of the present disclosure, numerous specific details are set forth in order to provide a thorough understanding of the present disclosure. However, it will be understood that the present disclosure may be practiced without these specific details. In other instances, well-known methods, functions, constituents, procedures, and components have not been described in detail so as not to unnecessarily obscure aspects and/or features of the present disclosure.

Figure 1:
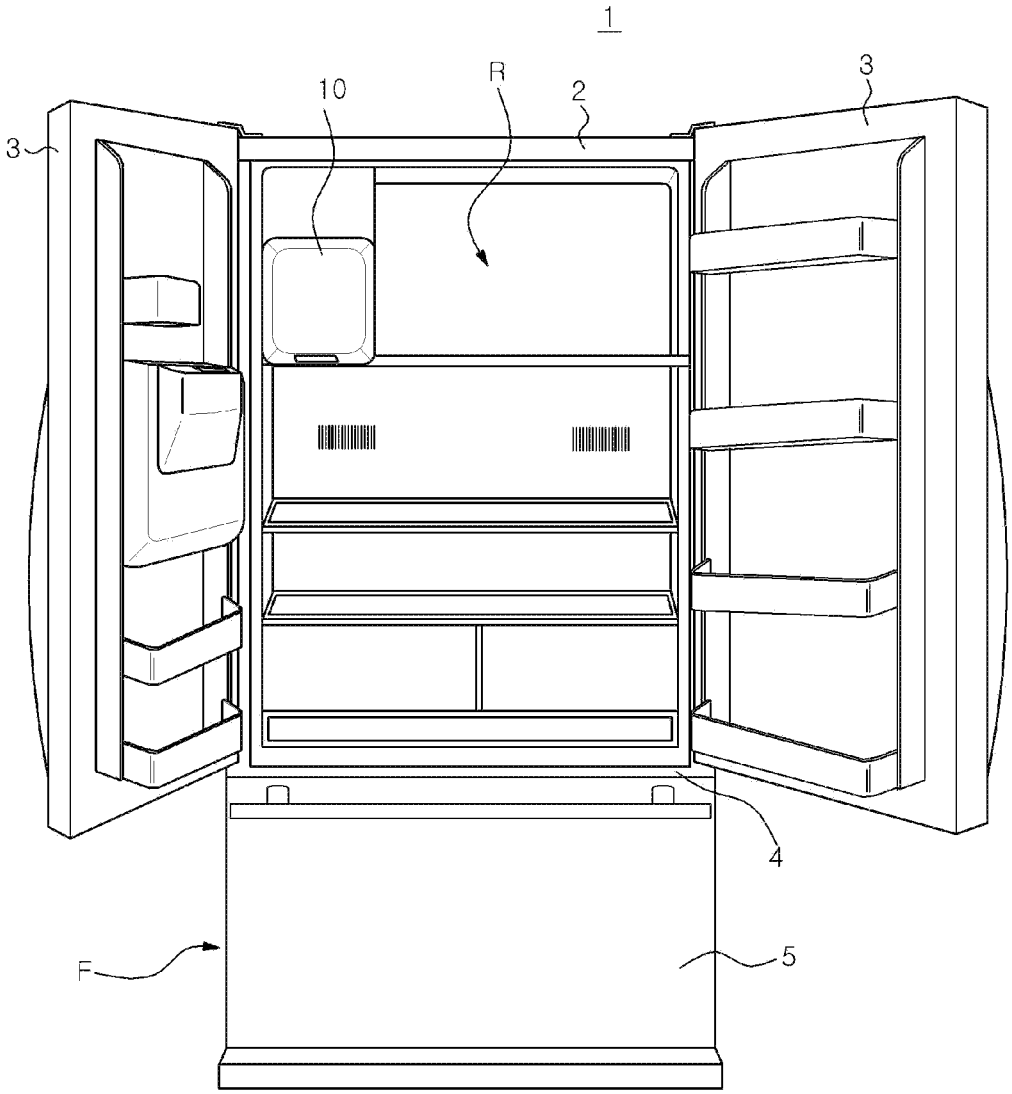
FIG. 1 is a diagram illustrating a refrigerator unit including an ice maker, in accordance with one embodiment of the present invention.
Figure 2:
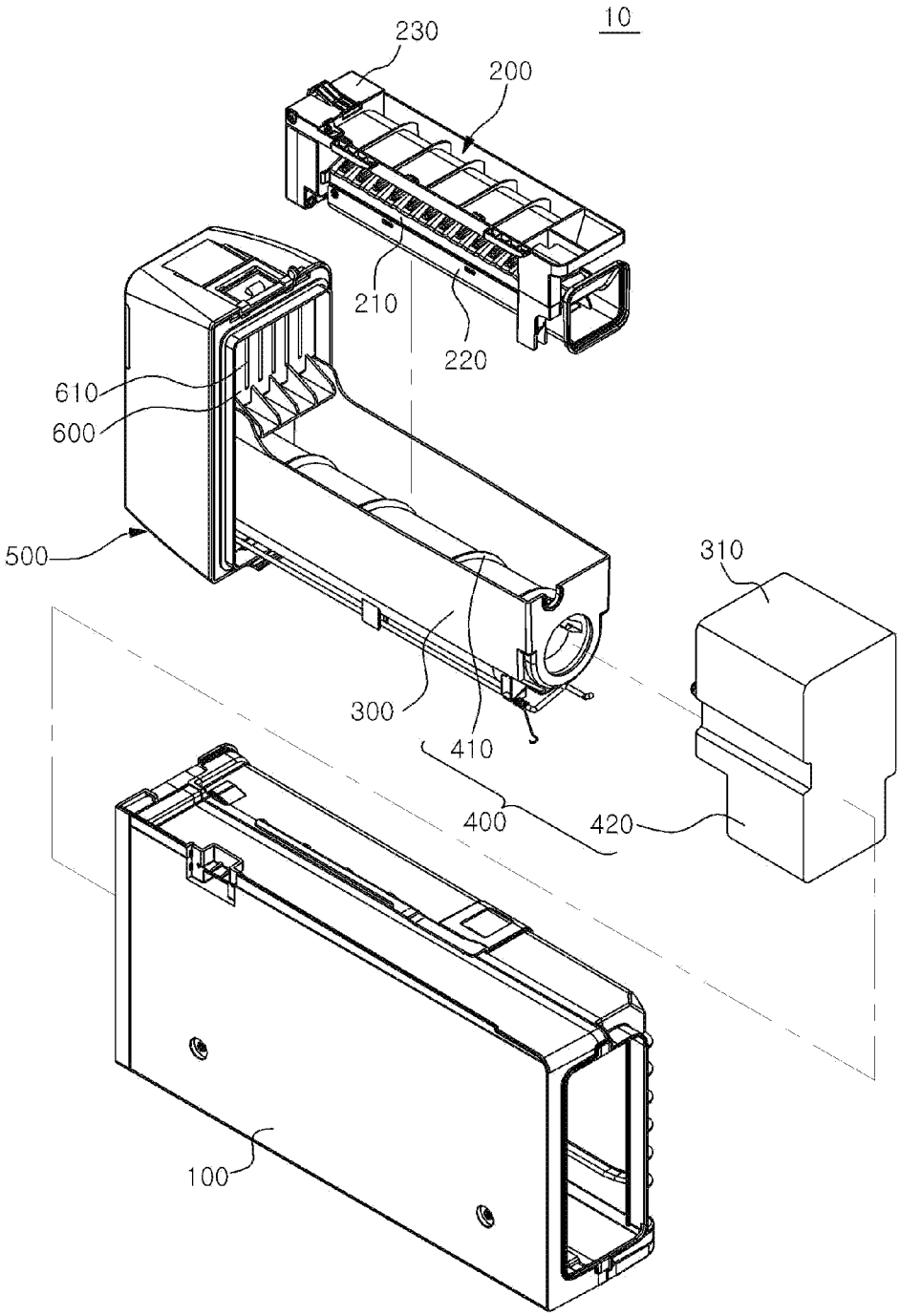
FIG. 2 is an exploded perspective view of an ice maker, in accordance with one embodiment of the present invention.
Figure 3:
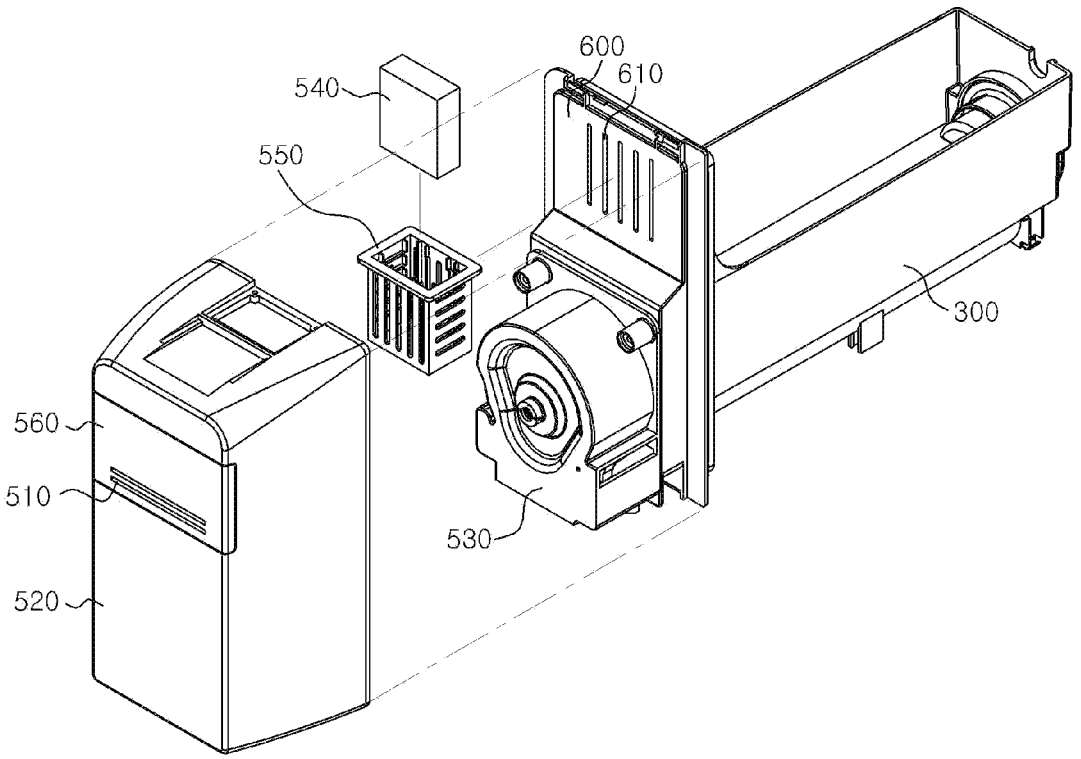
FIG. 3 is an exploded perspective view of a discharge assembly included in an ice maker, in accordance with one embodiment of the present disclosure.

FIG. 1 is a diagram illustrating a refrigerator unit including an ice maker, in accordance with one embodiment of the present invention. FIG. 2 is an exploded perspective view of an ice maker, in accordance with one embodiment of the present invention. FIG. 3 is an exploded perspective view of a discharge assembly included in an ice maker, in accordance with one embodiment of the present disclosure.

As shown in FIGS. 1-3, an ice maker 10 for a refrigerator unit may include a case 100, an ice making assembly 200, an ice bucket 300, a transfer assembly 400, and a discharge assembly 500 of embodiments of the present invention.

More particularly, as shown in FIG. 1, the refrigerator unit 1 including the ice maker 10 may include a body 2 configured for forming an external appearance or exterior. A barrier 4 is configured for dividing a space formed in the interior cavity of the body 2, used for storing food and drink contained therein, into a refrigeration compartment (R) at the top thereof and a freezer compartment (F) at the bottom thereof. One or more doors may be configured to selectively isolate the interiors of the compartments from the surrounding environment. For example, at least one refrigeration compartment door 3 is configured for selectively closing at least a portion of a front opening of the refrigeration compartment through contact with edges/rims to sides of a front face of the body 2, wherein the refrigeration compartment door is used for selectively opening and closing the refrigeration compartment (R) through a rotary motion. A freezer compartment door 5 is configured for covering and/or closing a front opening of the freezer compartment (F).

In the present embodiment, although the ice maker 10 is illustrated as being provided at one side of the top of the refrigerator compartment (R), the location is provided merely for illustration purposes only. For example, the ice maker 10 may be installed in a different position within the interior of the refrigeration compartment (R), or at a different position such as the refrigeration compartment door 3, and the like.

The refrigerator unit 1 in accordance with this embodiment is a bottom freeze type refrigerator in which the freezer chamber is positioned in a lower portion thereof. Although some embodiments of the present invention are described in view of bottom type freeze type refrigerators, other embodiments of the present invention are not limited thereto, and may be applied to various types of refrigerators.

The case 100 forms a cooling space configured for allowing ice to be made therein. The ice making assembly 200 may be placed at the top on the inside of the cooling space. The ice bucket 300 may be placed at the bottom of the ice making assembly 200.

The ice making assembly 200 includes an ice tray 210 for containing water, a cold air guiding unit 220 configured for guiding a flow of cold air such that the cold air supplied from a cooling unit moves along the bottom surface of the ice tray 210, and a rotating unit 230 configured for dropping the ice made in the ice tray 210 by rotating the ice tray 210.

The cold air generated in the coating unit is supplied to the ice tray 210 in the cooling space in the case 100 through a discharge duct 310. The cooling unit may include a compressor, a condenser, an expansion valve and an evaporator, which construct a cooling and/or refrigeration cycle. The cooling unit generates the cold air by exchanging heat between a refrigerant and air. Furthermore, the cold air may be actively supplied to the ice tray 210 via the discharge duct 310 and the cold air guiding unit 220 by an air blower.

The ice tray 210 provides a space where water supplied from a water source is turned into ice. The ice tray 210 includes a plurality of ice-making spaces capable of containing the water, and is formed on the upper side thereof. The ice-making spaces may have various shapes according to a desired shape of ice. Also, the water quantity of the ice-making spaces may be variously adjusted.

The ice tray 210 may be made from metals having high heat conductivity. For example, the ice tray 210 may be made from aluminum. The higher the heat conductivity of the ice tray 210, the greater the heat exchange rate of the water and cold air, which uses less cooling cycles to make ice. Therefore, depending on the metal used, the ice tray 210 may play a role of a heat exchanger. Further, although it is not shown, a cooling rib or the like may be installed at the bottom surface of the ice tray 210 to increase a contact surface with the cold air, also reducing the number of cooling cycles to make ice.

The cold air guiding unit 220 functions to guide the cold air supplied from the cooling unit to the bottom of the ice tray 210. The cold air guiding unit 220 may be connected to the discharge duct 310, which forms a path through which the cold air circulates as it is being supplied from the cooling unit. The cold air guided by the cold air guiding unit 220 may be circulated to the bottom surface of the ice tray 210. The water contained in the ice tray 210 may be turned into ice by exchanging heat between the cold air and the ice tray 210.

Further, the ice formed in accordance with the description provided above may be dropped into the ice bucket 300 by the rotating unit 230. The ice bucket may be placed under the bottom of the ice tray 210. For illustration, the upper side of the ice tray 210 may be rotated to face the underlying ice bucket 300 by use of the rotating unit 230. The ice tray 210 may be twisted due to the interference of a certain interference member (not shown) when the ice tray 210 is rotated more than a specific angle. As a result, the ice contained in the ice tray 210 may be dropped to the ice bucket 300 due to the torsion.

The transfer assembly 400 is used to transfer the ice stored in the ice bucket 300 to a discharge assembly 500. The transfer assembly 400 may include an auger 410 and an auger motor (not shown), wherein the auger motor may be included in an auger motor housing 420.

The auger 410 may be a rotating member having a screw, spiral shaped wings, or the like, and is rotated by the auger motor. The auger 410 is configured to be located in the inside of the ice bucket 300. The ice accumulating in the ice bucket 300 is inserted between wings of the auger 410, for example, and then may be transferred toward the discharge assembly 500 when the auger 410 is rotated.

The discharge assembly 500 has an insulation space that is provided as a path for discharging the ice contained in the ice bucket 300 to the outside of the ice maker 10. The discharge assembly 500 may be connected with a dispenser (not shown) provided in the refrigeration compartment door 3. According to the selection of a user, the ice transferred by the transfer assembly 400 may be provided to the user through the dispenser.

The discharge assembly 500 may include an insulation case 520 having at least one insulation wall that is configured to form the insulation space. The discharge assembly may be connected to an opening of the case 100 to form an insulating wall of the case 100. The cold air circulating through the insulation space to the outside of the ice maker 10 is discharged through a discharge port 510 formed on one side of an insulation wall.

A partition 600 installed between the ice making assembly 200 and the discharge assembly 500 serves to divide the cooling space of the ice making assembly 200 and the insulation space of the discharge assembly 500. A ventilator 610 may be installed in the partition 600 and is configured for providing a cold air channel between the cooling space of the ice making assembly 200 and the insulation space of the discharge assembly 500.

The discharge assembly 500 may include a cutting device 530 capable of cutting the ice transferred from the ice making assembly 200 into a certain size.

In addition, the discharge assembly 500 includes a deodorizing filter 540 placed in the insulation space and is located above and/or adjacent to the cold air channel that allows the cold air to circulate from the insulation space to the ice bucket 300 via the cold air channel after the cold air circulates from the ice making assembly 200 to the insulation space. That is, the deodorizing filter 540 may be placed in a path of the cold air channel. The cold air then circulates through the ice bucket 300. The deodorizing filter 540 may be accommodated in a filter case 550 which is attached to one wall of the insulation case 520 and placed in the insulation space. As an example, the deodorizing filter 540 includes a plurality of porous deodorizing substances configured to absorb smelly particles contained in the air. The porous deodorizing substances may be manufactured by applying absorbing substances configured to absorb specific smelly particles on a porous base material. In embodiments of the present invention, the porous base material may be a material having multitudinous micro-holes, such as a granular activated carbon, a carbon fiber, a carbon sheet, a granular silica, a zeolite, and so on.

Furthermore, the discharge assembly 500 may include a heater 560 for increasing a temperature of the cold air contained in the insulation space before discharging it to the outside of the ice maker 10 through the discharge port 510. As an example, the heater 560 may be made in the form of attaching a certain length of a heating cable around the discharge port 510 of the insulation case 520.

Figure 4:
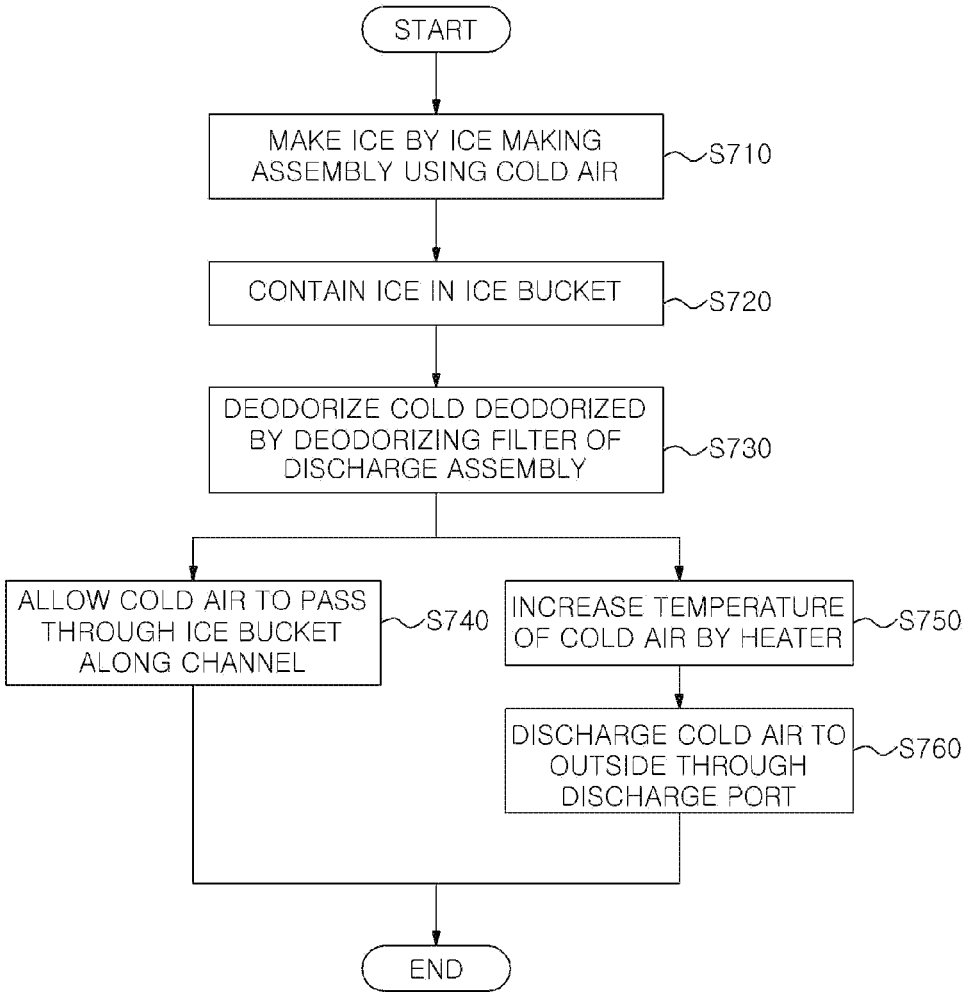
FIG. 4 is a flow diagram illustrating a method for deodorizing an odor of an ice maker, in accordance with one embodiment of the present disclosure.

FIG. 4 is a flow diagram illustrating a method for deodorizing an odor of an ice maker, in accordance with one embodiment of the present disclosure.

As described above in relation to FIGS. 1-3, the method for deodorizing an odor of an ice maker includes operation S710 for making ice by the ice making assembly 200 using cold air, wherein ice is made in the cooling space protected by the case 100.

The method further includes operation S720 for storing and/or containing the ice made by the ice making assembly 200 in the cooling space of case 100 in the ice bucket 300.

The method further includes operation S730 for deodorizing the cold air that is circulated from the cooling space of the ice making assembly 200, via a cold air channel formed at least in partition 600, to the insulation space in the insulator case 520 of the discharge assembly 500 by using the deodorizing filter 540 that is placed in the insulation space.

The method further includes operation S740 for enabling cold air deodorized by the deodorizing filter 540 to circulate over and/or through the ice bucket 300 via the cold air channel.

The method further includes operation S750 for increasing a temperature of the cold air deodorized by the deodorizing filter 540 in the insulation space by using the heater 560.

Then, the method further includes operation S760 for discharging the cold air having the raised temperature to the outside of the ice maker 10 through the discharge port 510, which is formed on one side of the insulation wall of the insulation case 520.

Hereinafter, a function and effect of the ice maker 10 of FIGS. 1-3 implementing the method of FIG. 4 will be described in accordance with one embodiment of the present invention.

In accordance with an embodiment of the ice maker 10, the cold air is generated through a compressor, a condenser, an expansion valve and an evaporator. The cold air is passed through the discharge duct 310, and then supplied to the cooling space protected by the case 100. The cold air thereby freezes the water contained in the ice tray 210. In this case, since the cold air guiding unit 220 is connected to the discharge duct 310 in an extended form, the cold air discharged from the discharge duct 310 may be moved along the cold air guiding unit 220.

The cold air performs a heat-exchange operation with the bottom surface of the ice tray 210, while moving along the bottom surface of the ice tray 210. As such, the water contained in the ice tray 210 may be turned into an ice (S710).

The ice made in the ice tray 210 may be dropped by rotating the rotating unit 230 so that a top portion is faced towards the ice bucket 300. The ice may accumulate in the ice bucket 300 placed in the bottom of the cooling space of case 100 (S720).

The ice accumulating in the ice bucket 300 may be placed and/or inserted between wings of the auger 410. The accumulating ice is then transferred to the discharge assembly 500 when the auger 410 is rotated.

The discharge assembly 500 has an insulation space that is configured to provide a path for discharging the ice contained in the ice bucket 300 to the outside of ice maker 10. The cutting device 530 may cut the ice transferred from the ice making assembly 200 into a certain size, and then provide it to the user through the dispenser that may be equipped with or within the refrigeration compartment door 3.

Meanwhile, the cold air discharged from the discharge duct 310 goes by and/or circulates through the ice making assembly 200. The cold air then circulates from the ice making assembly 200 to the insulation space of the discharge assembly 500 through a vent 610 of the partition 600. Then, after circulating through the insulation space, the cold air may flow via the cold air channel formed at least in the vent 610 to the ice bucket 300. The cold air may circulate through the ice bucket 300.

In embodiments of the present invention, the deodorizing filter 540 placed in the insulation space of the insulation case 520 eliminates smells by absorbing smelly particles contained in cold air (S730).

Thereafter, the cold air deodorized by the deodorizing filter 540 circulates from the insulation space to the ice bucket 300 via the cold air channel (S740). The cold air that is deodorized may circulate through the ice bucket 300.

Furthermore, the cold air from which smells are eliminated by the deodorizing filter 540 may be discharged to the outside of the ice maker 10 through the discharge port 510 formed in the insulation case 520. In this regard, the discharge of the cold air to the outside through the discharge port 510 means an inrush of cold air into the refrigeration compartment (R) of the refrigerator unit 1. In this case, since a temperature of the refrigeration compartment (R) is higher than a temperature of the cold air, a temperature difference exists between the insulation space that is inside the insulation case 520 and the refrigeration compartment (R), which may cause dew to be formed around the discharge port 510.

In order to prevent the dew formation, before the cold air is discharged to the outside of the ice maker 10 through the discharge port 510, the heater 560 raises a temperature of the cold air. In one embodiment, heater 560 compares a measured temperature value of the refrigeration compartment (R) with a predetermined threshold value. The heater 560 may then be operated if it is determined that dew may be formed based on the measured difference. Alternatively, the heater 560 may be periodically operated according to a predetermined operating period (S750).

Next, the cold air of which its temperature is raised by the heater 560 is discharged to the outside of ice maker 10 through the discharge port 510. Because of the rise in temperature of the cold air, dew is not formed around the discharge port 510.

Thus, according to embodiments of the present invention, an ice maker and a method for deodorizing the same are disclosed.

The foregoing description, for purpose of explanation, has been described with reference to specific embodiments of an ice maker and a method for deodorizing the same. However, the illustrative discussions above are not intended to be exhaustive or to limit the invention to the precise forms disclosed. It should be construed that the present invention has the widest range in compliance with the basic idea disclosed in the invention. Many modifications and variations are possible in view of the above teachings. Although it is possible for those skilled in the art to combine and substitute the disclosed embodiments to embody the other types that are not specifically disclosed in the invention, they do not depart from the scope of the present invention as well. The embodiments were chosen and described in order to best explain the principles of the invention and its practical applications, to thereby enable others skilled in the art to best utilize the invention. Further, it will be understood by those skilled in the art that various changes and modifications may be made without departing from the scope of the invention as defined in the following claims.

The process parameters and sequence of steps described and/or illustrated herein are given by way of example only and can be varied as desired. For example, while the steps illustrated and/or described herein may be shown or discussed in a particular order, these steps do not necessarily need to be performed in the order illustrated or discussed. The various example methods described and/or illustrated herein may also omit one or more of the steps described or illustrated herein or include additional steps in addition to those disclosed.

Embodiments according to the invention are thus described. While the present disclosure has been described in particular embodiments, it should be appreciated that the invention should not be construed as limited by such embodiments.

What is claimed is:

1. An ice maker for a refrigerator, comprising:

a case for protecting a cooling space to which cold air is supplied;

an ice making assembly for making ice by using the cold air in the cooling space;

an ice bucket located in the cooling space configured for storing the ice made by the ice making assembly;

a discharge assembly located outside the cooling space and comprising an insulation space, wherein the discharge assembly is configured to provide a path through which the ice stored in the ice bucket is discharged to the outside of the case; and a deodorizing filter placed in a path of a cold air channel that is configured to allow the cold air to circulate from the insulation space to the ice bucket after the cold air circulates from the ice making assembly to the insulation space via the cold air channel, wherein the discharge assembly comprises an insulation case having at least one insulation wall which is configured to form the insulation space, wherein the insulation case is configured to discharge the cold air circulating through the insulation space to the outside of the case through a discharge port formed at one side of the insulation wall, wherein the ice maker further comprises a partition installed between the ice making assembly and the discharge assembly, wherein the cooling space is spatially separated from the insulation space by the partition, and wherein the deodorizing filter is disposed in the insulation space, and wherein the partition comprises a ventilator configured to provide the cold air channel formed between the cooling space and the insulation space.

2. The ice maker of claim 1, wherein the discharge assembly comprises a heater for increasing a temperature of the cold air before discharging the cold air to the outside of the case through the discharge port.

3. The ice maker of claim 1, wherein the deodorizing filter is accommodated in a filter case that is attached to the insulation case and located in the insulation space.

4. A method for deodorizing an odor of an ice maker used in a refrigerator, the method comprising:

making ice by an ice making assembly using cold air, wherein the ice making assembly is located in a cooling space protected by a case;

storing the ice made by the ice making assembly in the cooling space, wherein the ice is stored in an ice bucket;

deodorizing the cold air circulating from the ice making assembly to an insulation space formed by a discharge assembly via a cold air channel by using a deodorizing filter placed in a path of the cold air channel; and allowing the cold air deodorized by the deodorizing filter to circulate from the insulation space to the ice bucket via the cold air channel, wherein the discharge assembly is located outside the cooling space and comprises an insulation case having at least one insulation wall which is configured to form the insulation space, wherein the insulation case is configured to discharge the cold air circulating through the insulation space to the outside of the case through a discharge port formed at one side of the insulation wall, wherein the ice maker further comprises a partition installed between the ice making assembly and the discharge assembly, wherein the partition spatially separates the cooling space from the insulation space, wherein the deodorizing filter is disposed in the insulation space, and wherein the partition comprises a ventilator configured to provide the cold air channel between the cooling space and the insulation space.

5. The method of claim 4, further comprising:

increasing a temperature of the cold air before discharging the cold air to the outside through the discharge port.

6. The method of claim 4, further comprising:

dispensing the ice to the outside of the case through the insulation space of the discharge assembly.

7. A refrigerator, comprising:

a freezer compartment located within a main body of the refrigerator;

a refrigeration compartment located within the main body of the refrigerator;

a case located within the refrigeration compartment, wherein the case is configured for protecting a cooling space to which cold air is supplied;

an ice making assembly for making ice by using the cold air in the cooling space;

a bucket located in the cooling space for storing the ice made by the ice making assembly;

a discharge assembly located outside the cooling space and comprising an insulation space, wherein the discharge assembly is configured to provide a path through which the ice stored in the ice bucket is discharged to the outside of the case; and a deodorizing filter placed in a path of a cold air channel that is configured to allow the cold air to circulate from the insulation space to the ice bucket after the cold air circulates from the ice making assembly to the insulation space, wherein the discharge assembly comprises an insulation case having at least one insulation wall which is configured to form the insulation space, wherein the insulation case is configured to discharge the cold air circulating through the insulation space to the outside of the case through a discharge port formed at one side of the insulation wall, wherein the refrigerator further comprises a partition installed between the ice making assembly and the discharge assembly, wherein the partition makes the cooling space spatially separated from the insulation space, wherein the deodorizing filter is disposed in the insulation space, and wherein the partition comprises a ventilator configured to provide the cold air channel between the cooling space and the insulation space.

8. The refrigerator of claim 7, wherein the discharge assembly comprises a heater for increasing a temperature of the cold air before discharging the cold air to the outside of the case through the discharge port.

9. The refrigerator of claim 7, wherein the deodorizing filter is accommodated in a filter case that is attached to the insulation case and located in the insulation space.

10. The refrigerator of claim 7, further comprising:

a dispenser integrated within a refrigeration compartment door, wherein the refrigerator compartment door is configured to isolate the refrigeration compartment from a surrounding environment and to provide access to the refrigeration chamber, and wherein the dispenser is aligned with the discharge assembly for receiving ice and discharging ice to the outside of the case.

11. The refrigerator of claim 7, wherein the freezer compartment is below the refrigeration compartment.

12. The ice maker of claim 1, wherein the cooling space is outside the insulation space.

* * * * *